US006318571B1

(12) United States Patent
Maumus et al.

(10) Patent No.: US 6,318,571 B1
(45) Date of Patent: Nov. 20, 2001

(54) LOADER DEVICE FOR SUPPORTING PARTS FOR HEAT TREATMENT IN A FURNACE

(75) Inventors: Jean-Pierre Maumus, Saint Medard en Jalles; Guy Martin, Saint Aubin de Medoc; Jean-Roch Vivier, Eysines, all of (FR)

(73) Assignee: Societe Nationale D'Etude et de Construction de Moteurs D'Aviation - S.N.E.C.M.A., Paris (FR)

( * ) Notice: Subject to any disclaimer, the term of this patent is extended or adjusted under 35 U.S.C. 154(b) by 0 days.

(21) Appl. No.: 09/581,492

(22) PCT Filed: Dec. 15, 1998

(86) PCT No.: PCT/FR98/02732

§ 371 Date: Jun. 14, 2000

§ 102(e) Date: Jun. 14, 2000

(87) PCT Pub. No.: WO99/31284

PCT Pub. Date: Jun. 24, 1999

(30) Foreign Application Priority Data

Dec. 15, 1997 (FR) ..... 97 15842

(51) Int. Cl.[7] ..... A47B 43/00
(52) U.S. Cl. ..... 211/194
(58) Field of Search ..... 211/194, 85.5, 211/49.1, 126.2, 126.3, 126.4, 126.7, 126.11, 126.12, 128.1, 130.1

(56) References Cited

U.S. PATENT DOCUMENTS

| | | | | |
|---|---|---|---|---|
| 653,699 | * | 7/1900 | Robinson | 211/49.1 |
| 2,483,160 | * | 9/1949 | Suggs | 211/85.5 |
| 3,115,253 | * | 12/1963 | Malbin et al. | 211/128.1 |
| 3,335,870 | * | 8/1967 | Hills | 211/194 |
| 4,099,627 | * | 7/1978 | Strada | 211/194 |
| 4,403,702 | * | 9/1983 | Belokin, Jr. | 211/194 |
| 4,453,640 | * | 6/1984 | Cillario | 211/194 |
| 4,697,856 | * | 10/1987 | Abraham | 211/194 |
| 4,892,197 | * | 1/1990 | Slattery et al. | 211/194 |
| 5,031,779 | * | 7/1991 | Szenay et al. | 211/194 |
| 5,458,243 | * | 10/1995 | McBride | 211/126.4 |
| 6,062,398 | * | 5/2000 | Thalmayr | 211/126.2 |

FOREIGN PATENT DOCUMENTS

| | | |
|---|---|---|
| 25 42 083 | 3/1976 | (DE) . |
| 30 20 888 | 12/1981 | (DE) . |
| 0 324 183 | 7/1989 | (EP) . |
| 0 518 746 | 12/1992 | (EP) . |
| 874 873 | 8/1961 | (GB) . |

* cited by examiner

*Primary Examiner*—Alvin Chin-Shue
*Assistant Examiner*—Sarah Purol
(74) *Attorney, Agent, or Firm*—Weingarten, Schurgin, Gagnebin & Hayes LLP

(57) ABSTRACT

The loader device is made of a thermostructural composite material and comprises a base (20), a loading pole (30) secured to the base and extending at least over the full height of the loader device, and a plurality of loading trays (40) each provided with a central passage through which the loading pole can pass. Each loading tray carries a plurality of spacers (50) enabling the trays to be mounted in succession at predetermined intervals, each tray carrying the same number of spacers which are in alignment so that after the trays have been assembled the spacers make up load-carrying columns extending over the height of the loader device, and at least one of the spacers carried by each tray has a disposition and/or a size that differs from the other spacers carried by the same tray so as to enable the trays to be indexed during assembly. Each tray (40) has means (45) for positioning parts at predetermined locations.

17 Claims, 2 Drawing Sheets

LOADER DEVICE FOR SUPPORTING PARTS FOR HEAT TREATMENT IN A FURNACE

Figure 1:
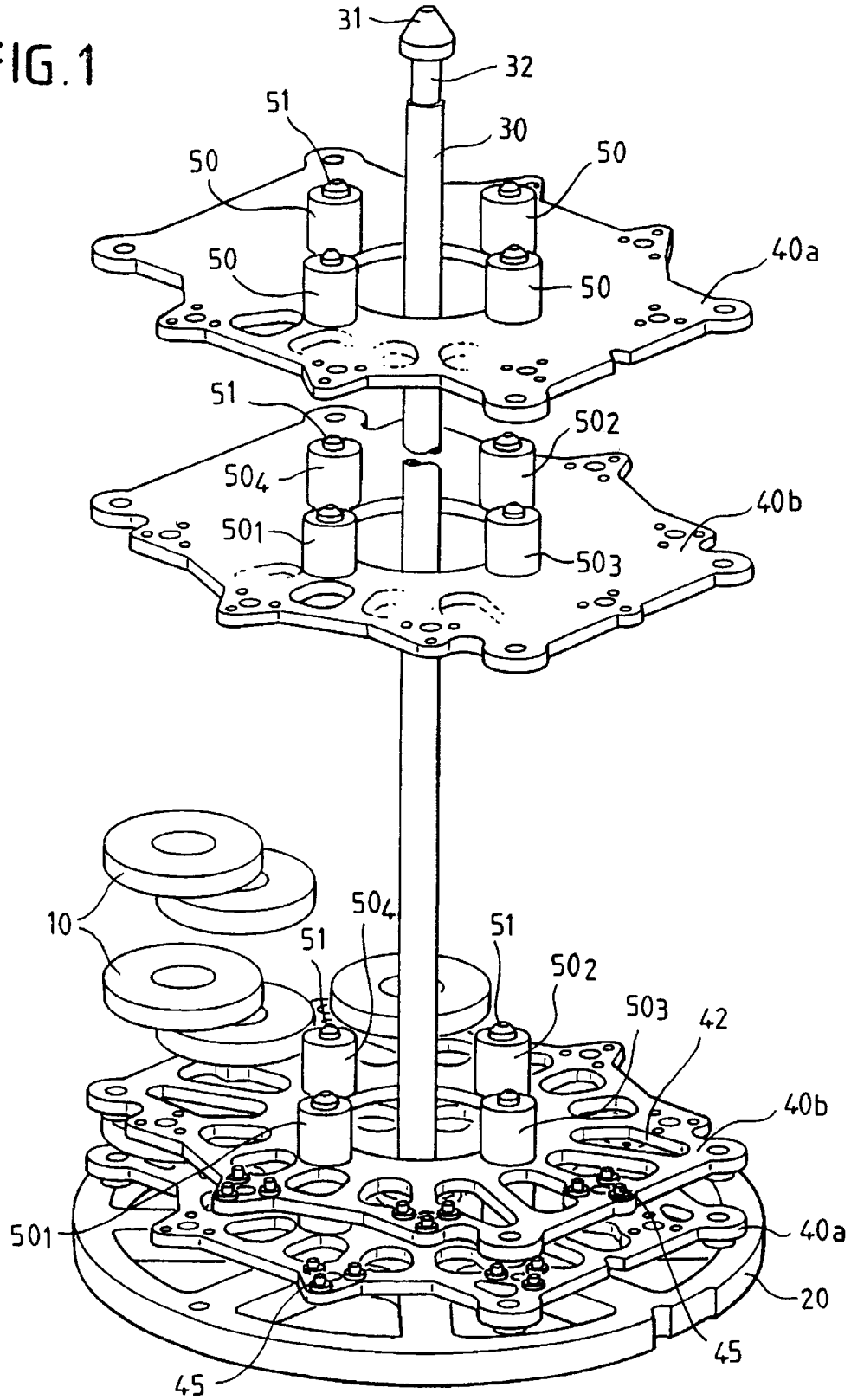

The present invention relates to a loader device or tool for supporting parts in a heat treatment furnace.

A particular but non-exclusive field of application for the invention is that of tooling for supporting parts to be subjected to treatment in a cementation furnace.

In this field, the tooling most commonly in use is made of metal. It suffers from two main drawbacks:

it too is subjected to cementation and rapidly becomes brittle, which can give rise to major disturbances inside furnaces; and under the effect of temperature it deforms, thereby causing the parts it carries to be deformed, which can require them to be corrected subsequently with consequent loss of thickness in the layer of cementation, thereby also making the operations of loading and unloading unsuitable for robotization because of poor positional accuracy; and also giving rise to potential difficulties when deformed tooling is to be inserted into a quenching unit.

It is already known, in particular from document EP-A-0 518 746 to use a thermostructural composite material instead of a metal to make the soleplates of heat treatment furnaces. A plurality of soleplates can be provided that are spaced apart from one another by spacers that are likewise made of thermostructural composite material. The composite material used is a carbon-carbon (C/C) composite material or a ceramic matrix composite (CMC) material having mechanical properties that enable them to act as structural elements and retaining those properties at high temperatures.

However, the loader device described in document EP-A-0 518 746 turns out to be unsuitable for achieving optimum loading as is often desired because of the relatively large number of parts to be treated. In addition, that known device is unsuitable for enabling the operations of loading and unloading the parts to be performed robotically.

The present invention seeks to remedy the above-mentioned drawbacks of prior art devices, and to this end it provides a loader device made of thermostructural composite material and comprising: a base; a loading pole secured to the base, projecting from the central portion of the base and extending over at least the full height of the loader device; a plurality of loading trays each provided with a central passage for passing the loading pole; and each loading tray carrying a plurality of spacers enabling successive trays to be assembled at predetermined intervals, each tray carrying the same number of spacers, with the spacers being aligned so that, once the trays have been assembled, the spacers make up load-carrying columns extending up the height of the loader device, and at least one of the spacers carried by each tray having a disposition and/or a size that is different from the other spacers carried by the same tray so as to enable the trays to be indexed while they are being assembled.

Because it is made of thermostructural composite material and because of the presence of means for indexing the trays, the loader device makes it possible to comply with the conditions of dimensional stability and precision that are required to enable the operations of loading and unloading the parts for treatment to be robotized.

Advantageously, each tray has part-positioning means for positioning parts in predetermined locations. In an embodiment, the loader device has first trays on which the part-positioning means occupy first positions relative to the spacers, and second trays on which the part-positioning means occupy second positions relative to the spacers, which second positions are different from the first positions. The first trays alternate with the second trays so that the part-positioning means are not all in vertical alignment. Each tray has spacer-receiving means suitable for receiving the ends of the spacers carried by a tray situated beneath it. On each tray, the disposition of at least one spacer relative to the axis of the pole is different from that of the other spacers, and at least one spacer is of a size that is different from that of the other spacers so that two identical trays cannot be mounted one immediately above the other and so that the trays can be assembled only in the required angular positions around the axis of the pole.

In another embodiment, the positioning means comprise at least some of the spacers. Each tray has spacer-receiving means suitable for receiving the ends of spacers carried by a tray situated beneath it. The disposition of at least one spacer on each tray relative to the axis of the pole is different from the disposition of the other spacers, and/or the size thereof is different from that of other spacers so that identical trays can be assembled together only in predetermined angular positions about the axis of the pole.

The spacers projecting from the space and the trays can be in the form of elements that are independent, or preferably in the form of elements that are secured to the base or to the tray that carries them.

Figure 2:
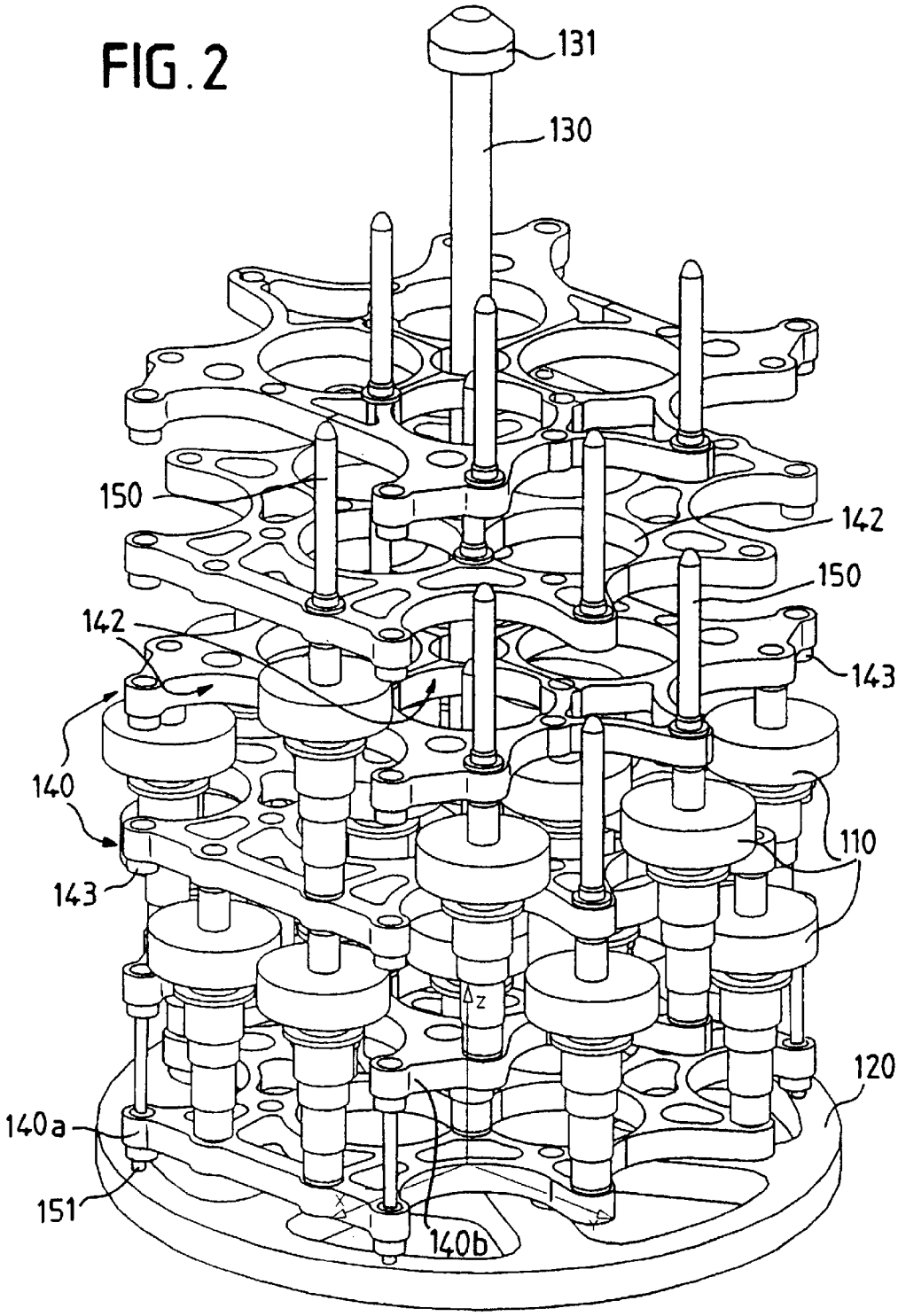

Other features and advantages of the present invention will appear on reading the following description given by way of non-limiting indication and with reference to the accompanying drawings, in which:

FIG. 1 is a fragmentary perspective view of a first embodiment of a loader device of the invention; and FIG. 2 is a perspective view of a second embodiment of a loader device of the invention.

The loader device or tooling shown in part in FIG. 1 is for use in loading a set of identical parts, e.g. steel gear-wheels 10 (represented by rings) for motor vehicles, for the purpose of subjecting them to cementation treatment in a furnace.

The loader device comprises a horizontal base 20 having a vertical loading pole 30 projecting from the center thereof and a plurality of horizontal trays 40 spaced apart along the pole 30 and separated from one another by means of spacers 50. The base 20 which supports the loader assembly is circular in shape and is provided with openings 21 which serve to reduce its weight and to facilitate the circulation of gas.

The free end of the loading pole 30 is terminated by an engagement head 31 connected to the remainder of the pole via a portion of small diameter 32 forming a groove, the head 31 enabling the loader assembly to be engaged by an automatic handling tool or machine.

The trays 40 (not all of them are shown) are of thickness that is considerably smaller than that of the base 20, and they lie within a circular outline having substantially the same diameter as the base. Each tray has a central passage 41 for passing the pole 30, and openings 42. The openings serve to lighten the tray, thereby reducing both its mass and its thermal inertia, and facilitating the circulation of gas over the entire height of the stack. Nevertheless, once the trays are in place, the openings 42 in the trays are not in exact alignment so as to avoid a "chimney" effect concerning the circulation of gas.

The parts 10 for treatment (not all shown) are placed on each tray at predetermined locations. To this end, groups of studs 45 are mounted in orifices formed in the trays. In each group of, for example, three studs 45, the studs lie within the inside circumference of a part 10.

Spacers 50 (not all shown) are carried by the base and by each of the trays and they are secured thereto e.g. by adhesive and/or by inserting their bottom ends in orifices formed in the base or in each tray. The top ends of the spacers 50 are terminated by respective cylindrical portions or heads 51 of smaller diameter that engage in respective orifices of corresponding diameter formed in the tray immediately above, with such engagement being facilitated by the top ends of the heads 51 being given a frustoconical shape. In the example shown, the base and each of the trays carries four spacers that are spaced apart at regular angular intervals about the axis, however the number of spacers could be different providing there are at least three spacers. The spacers carried by the base can be of smaller height if the base does not have means for supporting any parts. In a variant, it is possible to envisage providing the base with part support means and with spacers in the same manner as the trays 40*b* when the first tray mounted on the base is a tray 40*a*, or vice versa, the base then constituting a loader tray.

There are two types of tray referenced 40*a* and 40*b* which are installed in alternating manner. They differ from one another by the positions of the supports for the parts relative to the spacers. Thus, in the example shown, trays 40*a* have eight part-supports disposed at regular intervals around the axis of the tray, each part-support being on a radius that is at an angle of $\pi/8$ relative to the radius on which the closest spacer is to be found. In contrast, the trays 40*b* have eight part-supports disposed at regular intervals around the axis of the tray, with each part-support lying on a radius that is at an angle of 0 or $\pi/4$ relative to the radius on which the closest spacer is to be found.

Indexing and keying means enable the trays to be assembled by means of robots in the desired order (40*a*, 40*b*, 40*a*, 40*b*, . . . ) starting from the base and ensuring the desired angular position about the axis of the pole 30.

The keying means may be constituted by at least one of the spacer heads having a diameter that is different from that of the other spacer heads carried on the same tray or base. In the example shown, two opposite spacers $\mathbf{50}_1$ and $\mathbf{50}_2$ carried by a tray 40*a* have heads of diameter greater than the diameter of the heads of the other spacer $\mathbf{50}_3$, $\mathbf{50}_4$, whereas conversely the two opposite spacer heads $\mathbf{50}_1$, $\mathbf{50}_2$ carried by the base or a tray 40*b* have heads of diameter smaller than the diameter of the heads of the other spacers $\mathbf{50}_3$, $\mathbf{50}_4$. By giving the orifices in the trays 40*a* diameters that correspond to the spacer heads carried by the base or the trays 40*b*, and conversely by giving the orifices of the trays 40*b* diameters that correspond to the spacer heads carried by the trays 40*a*, it is ensured that two trays 40*a* or two trays 40*b* cannot be assembled one immediately above the other.

For angular indexing purposes, at least one of the spacers carried by each tray or base can be given a position that is different from the positions of the other spacers carried by the same tray or base, e.g. by locating the spacers at the vertices of an irregular polygon. In the example shown, one of the spacers, $\mathbf{50}_1$, is situated at a distance from the axis of the pole 30 that is greater than the distance at which the other spacers are situated.

Loading is performed by assembling the trays 40*a* and 40*b* in succession on the base, and each time a tray is assembled, by fitting it with parts 10, each located around a corresponding group of studs 45. In a variant, the trays could have the parts 10 fitted thereto prior to assembly. The locations of the parts, the order in which the trays are assembled, and the angular positions thereof are all predetermined, so loading can be performed automatically by means of a robot, and treated parts can likewise be unloaded by robot. When using robotic loading and unloading, it is preferable for both the first and the last tray of an assembly on the base to be of the same type, e.g. 40*a* as in the example shown. As a result, when the trays are to be transferred one by one from a first base to a second base, the first tray to be removed is also the first tray to be reinstalled. The total number of trays is then odd.

The angular positions of the trays are such that the spacers carried by the base and by each tray occupy the same positions so that the spacers in the assembly are in alignment, thereby forming columns extending up the entire height of the load. Each tray thus needs to carry only its own load (but not the load on any trays above it), which means that the trays can be thinner than the base. Unlike the spacers, the supports for parts are then not in vertical alignment, being angularly offset by $\pi/8$ between two successive trays. As a result, the parts to be treated are better distributed within the furnace, and gas flows that could give rise to non-uniform treatment of the parts are avoided.

The dimensional stability of the main components of the loader device (base 20, pole 30, trays 40, spacers 50) as necessary for obtaining the accuracy required for robotic loading and unloading is achieved by making these components out of thermostructural composite material.

Suitable composite materials are carbon-carbon (C/C) composites and ceramic matrix composite (CMC) materials. C/C composites are obtained by making a fiber preform out of carbon fibers and by densifying the preform by forming a carbon matrix within the pores thereof. The carbon matrix can be obtained by a liquid technique, i.e. by impregnating the preform with a liquid composition (such as a resin) that constitutes a precursor of carbon, and by applying heat treatment to transform the precursor into carbon, or else by a gas technique, i.e. by chemical vapor infiltration. CMCs are obtained by making a preform out of refractory fibers, e.g. carbon fibers or ceramic fibers, and densifying the preform by means of a ceramic matrix in the pores thereof. In well-known manner, the ceramic matrix, e.g. a silicon carbide (SiC) matrix can be obtained by a liquid technique or by chemical vapor infiltration.

In order to avoid adhesion between the contacting portions of each tray and the spacers supporting them, the surfaces of these contacting portions can be covered in metal foil or provided with an anti-adhesive coating, e.g. of boron nitride (BN). A BN coating can be obtained by chemical vapor deposition, with those surface portions that are not to be coated being masked.

The studs 25 constituting part-supports can be made of metal, e.g. steel. They are advantageously cold crimped in their housings. The studs can be coated in copper, e.g. by electrolytic copper plating, so as to prevent them from adhering to the steel parts to be treated.

FIG. 2 shows another embodiment of a loader device of the invention, intended more particularly for supporting elongate circularly symmetrical parts 110, such as hollow steel transmission shafts for motor vehicles, in order to enable them to be subjected to cementation treatment in a furnace.

In a manner similar to the embodiment described above, there can be seen a base 120 having a vertical pole 130 projecting form its center and terminated at its free end by an engagement head 131.

Horizontal trays 140 (not all shown) are mounted around the pole 130 at predetermined intervals, and they are spaced apart from one another by means of spacers 150 (not all shown) that also constitute supports for the parts 110 (not all shown).

The spacers 150 are in the form of independent rods which are engaged at their bottom ends in orifices formed in the tray that supports them and that have frustoconical free ends that engage in respective bushings 143 formed in the underside of the tray above.

In the example shown, the trays 140 comprise two types 140*a* and 140*b* that are disposed in alternation in two different angular positions about the axis of the pole 130 which passes through central passages 141 in the trays, with the total number of trays preferably being odd, as in the first embodiment.

In addition, each spacer 150 together with a part 110 engaged thereon, extends between two trays occupying the same angular position (e.g. two trays 140*a*), passing through openings or cutouts 142 formed in the angularly offset tray (140*b*) that is situated between said two trays (140*a*). Thus, each spacer extends over a height that is substantially twice the distance between two consecutive trays, thereby enabling parts of relatively long length to be supported while still optimizing loading. Provision can be made to use spacers that extend between two trays having some number n of trays inbetween them. In which case, the trays are distributed in n different groups, with trays in any one group occupying the same angular position that is different from the angular position occupied by any of the other groups.

The base and the bottom tray 140*a* carry special spacers 151 serving respectively to support the bottom tray 140*a* and the bottom tray 140*b* in the desired angular positions.

The dispositions of the spacers 150 (and of the bushings 143) carried by a tray 140*a* or 140*b* are different, in particular relative to the axis of the pole 130, so as to determine the angular position of the next tray of the same type situated above.

What is claimed is:

1. A loader device for supporting parts to be subjected to heat treatment in a furnace, said device being made of thermostructural composite material and comprising a plurality of trays spaced apart from one another by means of spacers, the device being characterized in that it comprises: a base; a loading pole secured to the base, projecting from the central portion of the base and extending over at least the full height of the loader device; a plurality of loading trays each provided with a central passage for passing the loading pole; and each loading tray carrying a plurality of spacers enabling successive trays to be assembled at predetermined intervals, each tray carrying the same number of spacers, with the spacers being aligned so that, once the trays have been assembled, the spacers make up load-carrying columns extending up the height of the loader device, and at least one of the spacers carried by each tray having a disposition and/or a size that is different from the other spacers carried by the same tray so as to enable the trays to be indexed while they are being assembled.

2. A device according to claim 1, characterized in that each tray has spacer-receiving means (50) suitable for receiving the ends of the spacers carried by a tray situated beneath it.

3. A device according to claim 1, characterized in that each tray has part-positioning means (45; 50) for positioning parts in predetermined locations.

4. A device according to claim 3, characterized in that the loader device has first trays on which the part-positioning means occupy first positions relative to the spacers, and second trays on which the part-positioning means occupy second positions relative to the spacers, which second positions are different from the first positions, and in that the first trays alternate with the second trays so that the part-positioning means are not all in vertical alignment.

5. A device according to claim 4, characterized in that on each tray, the disposition of at least one spacer relative to the axis of the pole is different from that of the other spacers, and at least one spacer is of a size that is different from that of the other spacers so that two identical trays cannot be mounted one immediately above the other and so that the trays can be assembled only in the required angular positions around the axis of the pole.

6. A device according to claim 3, characterized in that the positioning means comprise at least some of the spacers.

7. A device according to claim 1, characterized in that each spacer is secured to the tray that carries it.

8. A device according to claim 7, characterized in that the disposition of at least one spacer on each tray relative to the axis of the pole is different from the disposition of the other spacers, and/or the size thereof is different from that of other spacers so that identical trays can be assembled together only in predetermined angular positions about the axis of the pole.

9. A device according to claim 1, characterized in that the loader device has an odd number of trays.

10. A device according to claim 1, characterized in that the spacers carried by the base and by each tray are situated at the vertices of an irregular polygon.

11. A device according to claim 1, characterized in that each spacer carried by each tray has at its end a portion that is designed to engage in a corresponding housing in a tray above.

12. A device according to claim 11, characterized in that at least one of the spacers carried by each tray presents at its end a portion of small size that is different from the portions of small size at the ends of the other spacers carried by the same tray.

13. A device according to claim 1, characterized in that the spacers extend between two trays having one or more trays located between them, the trays forming a plurality of groups with the trays in each group occupying the same angular position that is different from the angular position of any other group.

14. A device according to claim 1, characterized in that the base constitutes a loading tray.

15. A device according to claim 2, characterized in that:

each tray has part-positioning means for positioning parts in predetermined locations;

the loader device has first trays on which the part-positioning means occupy first positions relative to the spacers, and second trays on which the part-positioning means occupy second positions relative to the spacers, which second positions are different from the first positions, and in that the first trays alternate with the second trays so that the part-positioning means are not all in vertical alignment;

on each tray, the disposition of at least one spacer relative to the axis of the pole is different from that of the other spacers, and at least one spacer is of a size that is different from that of the other spacers so that two identical trays cannot be mounted one immediately above the other and so that the trays can be assembled only in the required angular positions around the axis of the pole.

16. A device according to claim 6, characterized in that each spacer is secured to the tray that carries it;

the disposition of at least one spacer on each tray relative to the axis of the pole is different from the disposition of the other spacers, and/or the size thereof is different from that of other spacers so that identical trays can be assembled together only in predetermined angular positions about the axis of the pole;

the loader device has an odd number of trays;

the spacers carried by the base and by each tray are situated at the vertices of an irregular polygon.

17. A device according to claim 8, characterized in that each spacer carried by each tray has at its end a portion that is designed to engage in a corresponding housing in a tray above;

at least one of the spacers carried by each tray presents at its end a portion of small size that is different from the portions of small size at the ends of the other spacers carried by the same tray;

the spacers extend between two trays having one or more trays located between them, the trays forming a plurality of groups with the trays in each group occupying the same angular position that is different from the angular position of any other group; and the base constitutes a loading tray.

* * * * *

UNITED STATES PATENT AND TRADEMARK OFFICE

CERTIFICATE OF CORRECTION

PATENT NO. : 6,318,571 B1 
DATED : November 20, 2001
INVENTOR(S) : Jean-Pierre Maumus et al.

It is certified that error appears in the above-identified patent and that said Letters Patent is hereby corrected as shown below:

Column 5,
Line 57, delete "(50)"; and
Line 61, delete "(45; 50)".

Signed and Sealed this

Fifth Day of November, 2002

*Attest:*

*Attesting Officer*

JAMES E. ROGAN
*Director of the United States Patent and Trademark Office*